US005692643A

United States Patent [19]

Horino et al.

[11] Patent Number: 5,692,643

[45] Date of Patent: Dec. 2, 1997

[54] FLOW PASSAGE CLOSING MECHANISM OF A BEVERAGE POURING APPARATUS

[75] Inventors: Morikatsu Horino, Tokyo-to; Hiroshi Satoh, Fujisawa, both of Japan

[73] Assignees: Kirin Beer Kabushiki Kaisha; Dai-Ichi Electric Co., Ltd., both of Tokyo, Japan

[21] Appl. No.: 760,407

[22] Filed: Dec. 4, 1996

Related U.S. Application Data

[62] Division of Ser. No. 309,975, Sep. 20, 1994, Pat. No. 5,615,802.

[30] Foreign Application Priority Data

Sep. 20, 1993 [JP] Japan ..... 5-233651

[51] Int. Cl.[6] ..... B67D 1/04

[52] U.S. Cl. ..... 222/66; 137/399

[58] Field of Search ..... 222/62, 66, 67; 137/399

[56] References Cited

U.S. PATENT DOCUMENTS

| | | | |
|---|---|---|---|
| 932,153 | 8/1909 | Martin | 222/66 |
| 1,542,036 | 6/1925 | Conrader | 137/399 X |
| 1,985,663 | 12/1934 | Lowery | 137/399 |
| 2,496,518 | 2/1950 | Candler | 137/399 X |
| 2,715,414 | 8/1955 | Kinzbach et al. | 137/399 |
| 3,587,927 | 6/1971 | Scott | 222/66 |
| 5,615,802 | 4/1997 | Horino et al. | 222/66 |

*Primary Examiner*—Andres Kashnikow
*Assistant Examiner*—Kenneth Bomberg
*Attorney, Agent, or Firm*—Oblon, Spivak, McClelland, Maier & Neustadt, P.C.

[57] ABSTRACT

A flow passage closing mechanism of a beverage pouring apparatus for supplying the beverage to a dispenser by pushing the beverage in the keg due to the pressure of gas introduced therein. The mechanism includes a first connecting portion to be connected to the key, a descending tube connected to the first connecting portion, a floating ball movably inserted into the descending tube, a valve seat formed at a lower end portion of the descending tube, a separating mechanism for lifting the floating ball form the valve seat, and a second connecting portion to be connected to the dispenser. When beverage in the keg is used up, the flow passage closing mechanism closes the flow passage of the beverage pouring apparatus by pushing the floating ball to the valve seat. The flowing path is reopened by the separating mechanism.

4 Claims, 7 Drawing Sheets

FLOW PASSAGE CLOSING MECHANISM OF A BEVERAGE POURING APPARATUS

This is a Division of application Ser. No. 08/309,975, filed on Sep. 20, 1994, now U.S. Pat. No. 5,615,802.

BACKGROUND OF THE INVENTION

1. Field of the Invention

This invention relates to a closing mechanism for closing a flow passage connecting a keg of a beverage to a dispenser in a beverage pouring apparatus. The beverage pouring apparatus pours beverage, for example, beer etc., accommodated in the keg to the dispenser under pressure of carbonic acid gas introduced into the keg.

2. Discussion of the Background

Generally, a beverage, for example, draught beer etc., in a keg is supplied to a dispenser from the keg in the following manner. Namely, as shown in FIG. 9, a dispensing head 2 is attached to a mouth of a keg 1, and carbonic acid gas or nitrogen gas is introduced into the keg 1 from a gas cylinder 3 via the dispensing head 2 to push out beverage from the keg 1 under its pressure.

When beverage is poured into a cup 6 from a tap (pouring valve) 5 of a dispenser 4, the speed of flowing out of beverage from the tap 5 is most suitably set by adjusting the gas pressure of the gas cylinder 3 so that beverage poured to the cup 6 is not splashed or not bubbled in consideration of the viscosity of the beverage and the pipe friction of a flow passage 7 connecting the dispensing head 2 to the dispenser 4.

When a portion of the beverage remains in the keg 1, the beverage is smoothly poured at the flowing speed set as stated above. However, when none of the beverage remains in the keg 1, carbonic acid gas, etc., introduced into the keg 1 goes into the flow passage 7 connected to the dispenser 4 so as to be mixed with the remaining beverage therein.

Since the viscosity of the gas is much smaller than that of beverage, in the case where an operator continues pouring beverage into the cup 6 without being aware that the amount of the beverage remaining in the keg 1 is small, carbonic acid gas etc, mixed with beverage suddenly spurts at a high speed from the tap 5 and blows the beverage from the cup 6. Therefore, the clothes of the operator pouring the beverage are soiled. Further, in the case where the pouring is done at a store, the clothes of a customer are often soiled too.

In the case where a portion of the beverage sprinkled around the dispenser is left standing, since the beverage contains nutrition and sugar, mold is generated. Therefore, in view of sanitary conditions, it is necessary to prevent the gas from spurting.

Conventionally, for preventing the spurting of carbonic acid gas etc. from the tap as stated above, a flow passage closing mechanism as shown in FIG. 10 is used. The mechanism has a sensor S for sensing the existence of carbonic acid, gas, etc. mixed with the beverage in the flow passage 7, and a stopping valve V for closing the flow passage 7. The sensor S and the stopping valve V are respectively installed at the middle portion of the flow passage 7.

The flow passage closing mechanism in FIG. 10 is constructed so that the sensor S senses a change in electric conductivity of the beverage in the flow passage 7, a change in electrostatic capacity or a change in the quantity of light so as to change a four way solenoid valve 9 by a signal-generator 8 to thereby operate the stopping valve V under air pressure.

However, since the conventional flowing path closing mechanism stated above needs a power supply for the sensor S and the four way solenoid valve 9, and a pressure source for the stopping valve V, the mechanism becomes complex, large and costly.

Therefore, the conventional flowing path closing mechanism has a problem that it does not become popular easily.

SUMMARY OF THE INVENTION

An object of this invention is to provide a flow passage closing mechanism for a beverage pouring apparatus which can close a flow passage for a beverage without a driving source, for example, a power source and a pressure source etc., when a beverage in the flow passage is mixed with the gas of a pouring beverage.

For attaining the object stated above, a flow passage closing mechanism of this invention comprises a first connecting portion to be connected to the keg to introduce the beverage therein, a descending tube connected to the first connecting portion to flowing beverage in a downward direction, a floating ball movably inserted into the descending tube to float in the beverage flowing in the descending tube with its buoyancy, a valve seat formed at a lower end portion of the descending tube to close a flowing path in the descending tube with the valve seat being pushed by the floating ball thereto, a separating means for lifting the floating ball pushed to the valve seat to separate the floating ball therefrom, and a second connecting portion to be connected to the dispense for flow outward of the beverage passed through the descending tube to the dispenser.

The flow passage closing mechanism of this invention is attached to the beverage pouring apparatus by connecting the first connecting portion to the keg and the second connecting portion to the dispenser thereby to supply beverage poured from the keg to the dispenser via the first connecting portion, the descending tube and the second connecting portion.

At the time of pouring of beverage, the interior of the descending tube is filled with beverage to float the floating ball in the beverage to thereby separate it from the valve seat with the gravity acting on the floating ball in a downward direction being balanced with the buoyancy acting thereon in an upward direction. Therefore, the beverage introduced from the first connecting portion is supplied to the dispenser via the descending tube and the second connecting portion.

When the beverage in the keg is used up, gas introduced into the keg for the pouring beverage spouts into the descending tube to be mixed with the beverage in the descending tube thereby to decrease buoyancy acting on the floating ball. Therefore, the gravity acting on the floating ball becomes unbalanced with the buoyancy thereon to push the floating ball to the valve seat with the gravity thereby to close the flowing path. In this manner, the gas mixed with beverage is prevented from spouting to the dispenser.

After the empty keg is exchanged with a new one, the floating ball is separated from the valve sheet by the separating means to resume pouring of the beverage.

As stated above, when beverage in the keg is used up, the flow passage closing mechanism of this invention can close the flowing path of the beverage pouring apparatus which pours beverage in the keg under gas pressure to prevent gas from spouting. Further, the flowing path closing mechanism does not need a driving source, for example, a power source or a pressure source, etc., for closing the flow passage. Therefore, the construction of the flowing path closing mechanism is simple,.small and inexpensive.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

An example of this invention will now be explained with reference to the following drawings.

Figure 1:
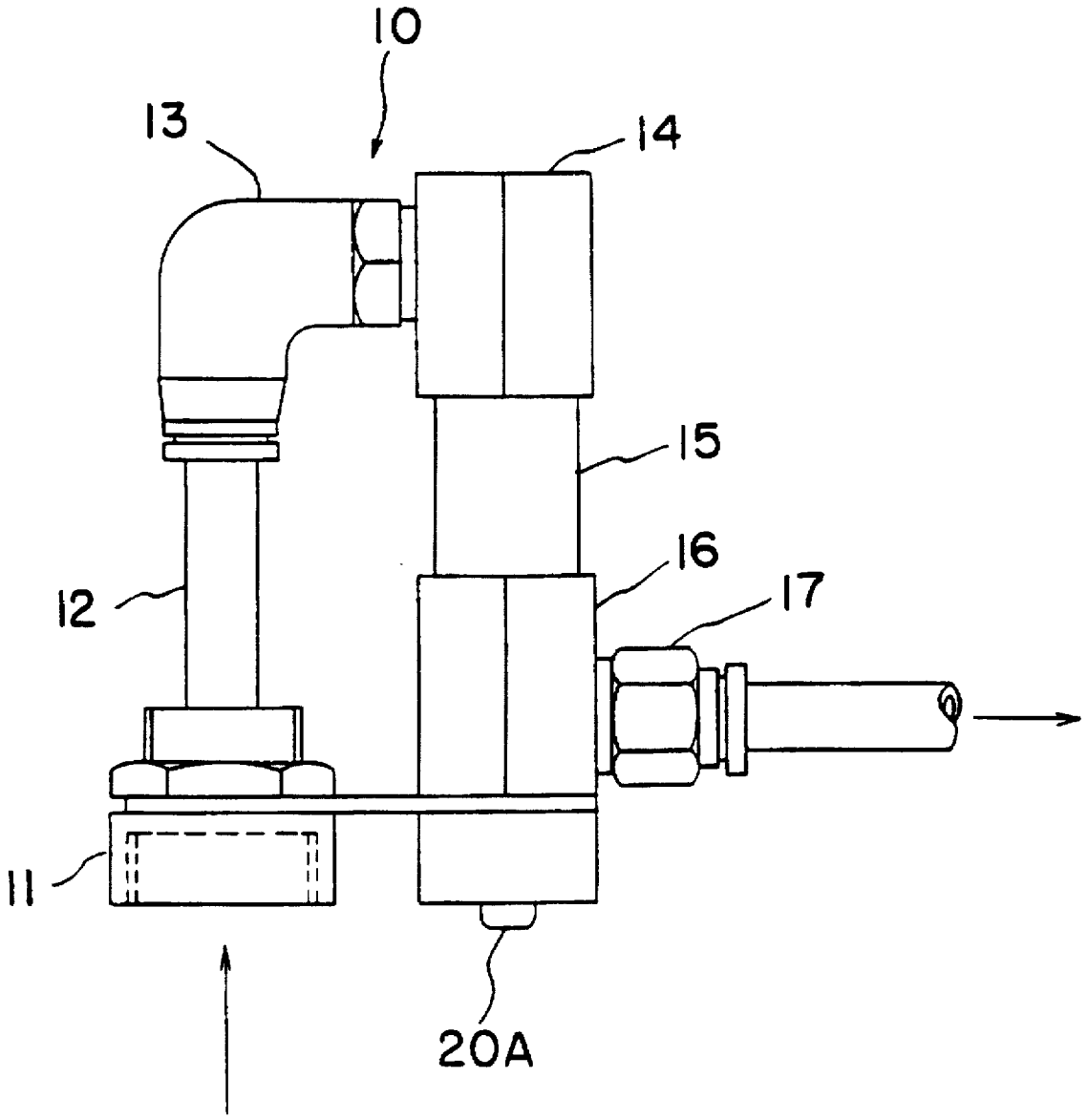
FIG. 1 is a side view of one example of this invention.
Figure 2:
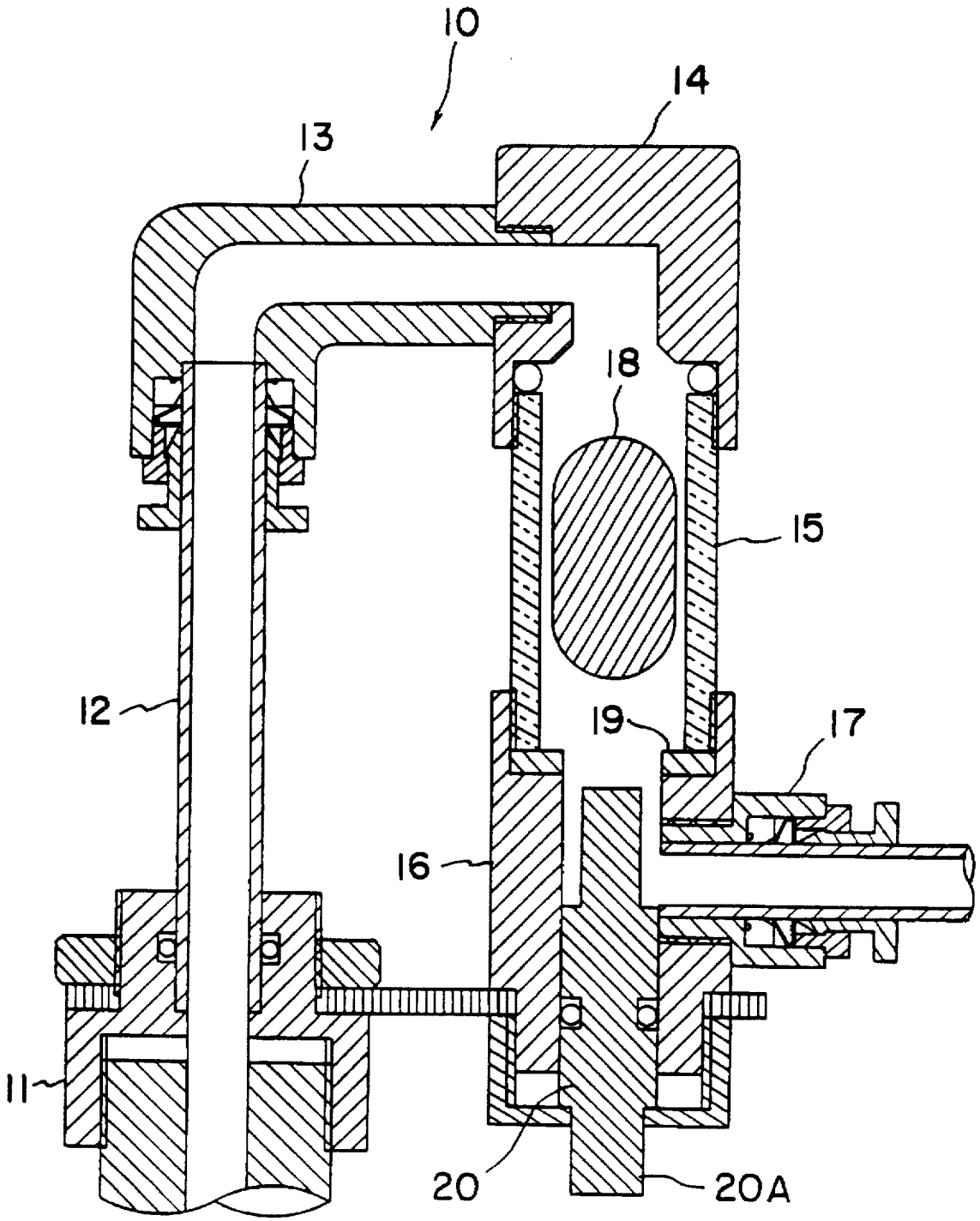
FIG. 2 is vertical sectional view of the same example as shown in FIG. 1.

In FIGS. 1 and 2, a flow passage closing mechanism 10 comprises a dispensing head connecting portion (a first connecting portion) 11, an ascending tube 12 extending in the upward direction from the connecting portion 11, a descending tube 15 connected to the upper end portion of the ascending tube 12 via an L-shaped tube 13 and an upper body 14, a valve seat body 16 connected to the lower portion of the descending tube 15, and a dispenser connecting portion (a second connecting portion) 17 connected to the valve seat body 16 thereby to form an inverted U-shaped flow passage.

The descending tube 15 is formed of a transparent material, for example, an acrylic resin. A floating ball 18 made of plastic is slidably inserted inside of the descending tube 15 in the vertical direction, as shown in FIG. 2.

The reason why the descending tube 15 is made of transparent material is to easily confirm the flow of beverage passing through the inside of the descending tube 15. However, the descending tube 15 is not necessarily made of transparent material, in case that there is no need to confirm the flow of the beverage passing therethrough.

The floating ball 18 is made of material which does not spoil the beverage in terms of food hygiene. The apparent specific gravity of the floating ball 18 is 0.9 or less, and the apparent density ρm of the floating ball 18 is set as follows.

Namely, a force acting on the floating ball 18 in an upward direction is the buoyancy force Fu, and a force acting thereon in downward direction is the sum of its tare W and the fluid resistance Rf which occurs due to the downward flow of the beverage in the descending tube 15. The floating ball 18 floats in the beverage flowing in the descending tube 15 under the following condition.

$$Fu=W+Rf$$

Suppose that the volume of the floating ball 18 is V, and the density of the beverage is ρl, the fluid resistance Rf and the tare W are represented as follows.

$$Fu=V\cdot\rho l,\ W=V\cdot\rho m$$

Therefore, the expression Fu=W+Rf is represented as follows.

$$V\cdot\rho l=V\cdot\rho m+Rf$$

Since the fluid resistance Rf is changed in accordance with the flow velocity, the density and the viscosity of the beverage, the apparent density ρm of the floating ball 18 is selected according to conditions of the kind of beverage, etc.

The shape of the floating ball 18 is formed so as to have minimum fluid resistance against the beverage flowing in the descending tube 15 in the downward direction. In the embodiment of the drawings, the floating ball 18 is formed in a cylindrical shape both ends of which are hemispherically shaped. However, the floating ball 18 can be of a cylindrical shape whose ends are respectively conically shaped, or in a spherically shaped.

A valve seat 19 having a diameter smaller than that of the floating ball 18 is installed at the lower end portion of the valve sheet body 16 to close the flowing path when the floating ball 18 abuts against the valve seat 19.

A pushing bar 20 is inserted into the valve seat body 16 slidably invertical direction. The pushing portion 20A formed at the lower end portion of the pushing bar 20 projects downwardly from the lower face of the valve seat body 16 to separate the floating ball 18 from the valve seat 19 by pushing the pushing portion 20A into the valve seat body 16 and by making the upper portion of the pushing bar 20 abut against the floating ball 18.

The flow passage closing mechanism 10 stated above is attached to a beverage pouring apparatus by connecting the dispensing head connecting portion 11 to a dispensing head (not shown), and by connecting the dispenser connecting portion 17 to a dispenser (not shown). Beverage poured from a keg via the dispensing head is supplied to the dispenser via the dispensing head connecting portion 11, the ascending tube 12, the L-shaped tube 13, the upper body 14, the descending tube 15, the valve seat body 16 and the dispenser connecting portion 17. The ascending tube 12, by interconnecting with connecting portion 4 and an upper portion of descending tube 15, forms an inverted U-shaped flow passage, as shown in FIG. 1.

At the time of beverage pouring the descending tube 15 is filled with the beverage, so that the floating ball 18 floats due to its buoyancy so as to separate from the valve seat 19. Therefore, the beverage introduced from the dispensing head connecting portion 11 flows into the valve seat body 16 through the descending tube 15 so as to be supplied to the dispenser through the dispenser connecting portion 17.

During beverage flow, the beverage flows in a downward direction in the descending tube 15 so that the fluid resistance of beverage acts on the floating ball 18 in a downward direction against its buoyancy.

The apparent specific gravity is set so that the buoyancy is larger than the fluid resistance thereby to prevent the floating ball 18 from being pushed to the valve seat 19.

When the beverage in the keg is totally consumed and carbonic acid gas introduced into the keg spouts from the dispensing head so as to be mixed with the beverage in the flow passage closing mechanism 10, the buoyancy acting on the floating ball 18 is greatly decreased, particularly since the density of carbonic acid gas is about one five hundredth of that of the beverage, for example, beer etc. Therefore, the floating ball 18 is pushed to the valve sheet 19 due to gravity to close the flow passage, and thereby prevents carbonic acid gas mixed with the beverage from flowing out to the valve sheet body 16 from the descending tube 15.

Therefore, there is no fear of sudden spouting of carbonic acid gas from the tap of the dispenser.

After the flowing path is closed by operating the flowing path closing mechanism 10 as stated above, the keg is exchanged with a new one.

The pushing portion 20A of the pushing bar 20 is pushed up to be inserted into the valve seat body 16 in such a manner that the upper end portion of the pushing bar 20 pushes up the floating ball 18 to separate the floating ball 18 from the valve seat 19 to thereby open between the descending tube 15 and the dispenser connecting portion 17. As a result, the carbonic acid gas stopped by the floating ball 18 can flow out to the dispenser to circulate the beverage.

When the beverage is introduced into the flow passage closing mechanism 10, the floating ball 18 is lifted due to its buoyancy so as to be kept separated from the valve seat 19 even when the pushing bar 20 is lowered from the flowing ball 18 as stated above.

In a desirable embodiment of the embodiment stated above, each inner diameter of two hoses, one of which connects the dispensing head to the flowing path closing mechanism, and the other of which connects the flowing path closing mechanism to the dispenser, is 5–6 mm, and the flow rate of the beverage is about 2.5–3.5 l/min. The reason why the flow rate is set as stated above is that if flow rate is smaller than 2.5 l/min, turbulent flow of beverage generates in the hose cause the beverage to easily bubble.

Further, in a desirable mode of the embodiment, the inner diameter of the descending tube 15 is 16 mm, the floating ball 18 is formed in a hollow, cylindrical shape of which the diameter is 10 mm, the length is 36 mm, and the apparent specific gravity is about 0.6.

Under the conditions as stated above, in the case where the beverage is beer and the flow rate is between 2.5 and 3.5 l/min, the floating ball 18 floats in beer due to its buoyancy so as not to prevent the flow of beer. When the beer in the keg is used up and carbonic acid gas spouts, the floating ball 18 is immediately pushed to the valve sheet 19 under the pressure of carbonic acid gas so as to close the flow passage.

Another embodiment of the flow passage closing mechanism of this invention is shown in FIGS. 3 to 7.

Figure 3:
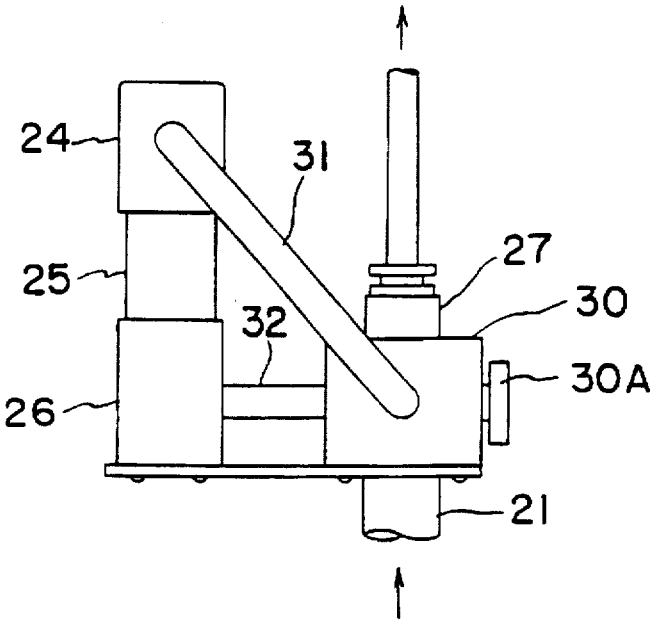
FIG. 3 is a side view of another example of this invention.
Figure 4:
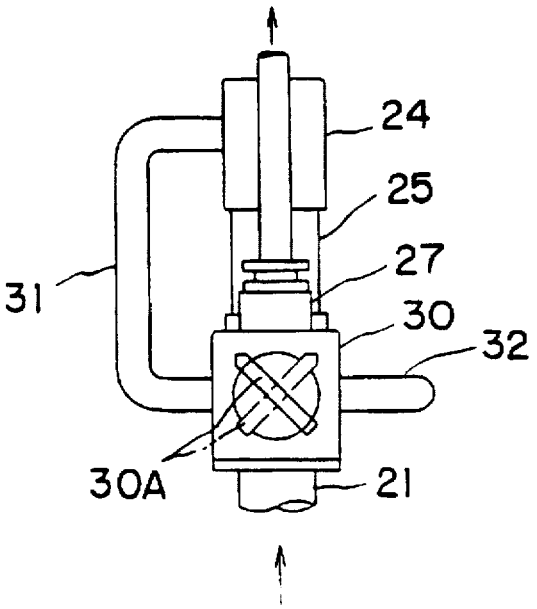
FIG. 4 is a front view of the same example as shown in FIG. 3.
Figure 5:
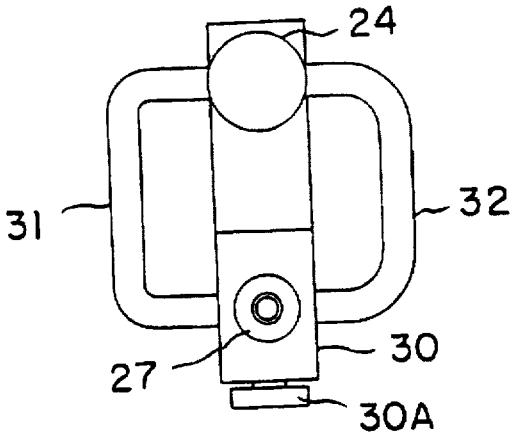
FIG. 5 is a plan view of the same example as shown in FIG. 3.

In FIGS. 3 to 5, the construction of a descending tube 25 having a floating ball inside thereof, a valve seat body 26 connected to the lower end portion of the descending tube 25 and an upper body 24 connected to the upper end portion of the descending tube 25 are the same as those referred to in the first embodiment. However, the flow passage closing mechanism of this embodiment has no pushing bar as called for in the first embodiment.

A dispensing head connecting portion 21 and a dispenser connecting portion 27 are respectively connected to a four way valve 30. One of connecting mouths of the four way valve 30 is connected to the upper body 24 via an ascending tube 31, and another mouth thereof is connected to the valve seat body 26 via a horizontal tube 32.

Figure 6:
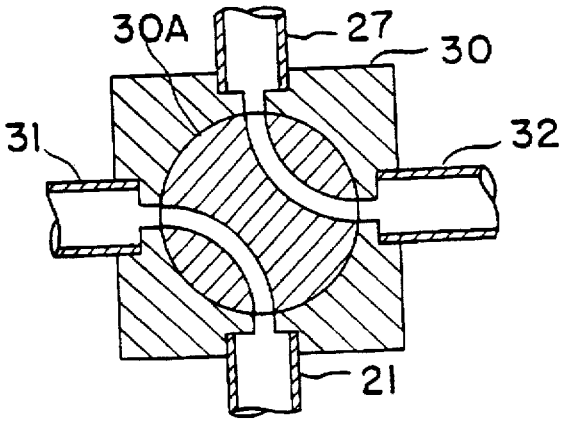
FIG. 6 is a cross sectional view of a four way valve of the same example as FIG. 3 in a first position.
Figure 7:
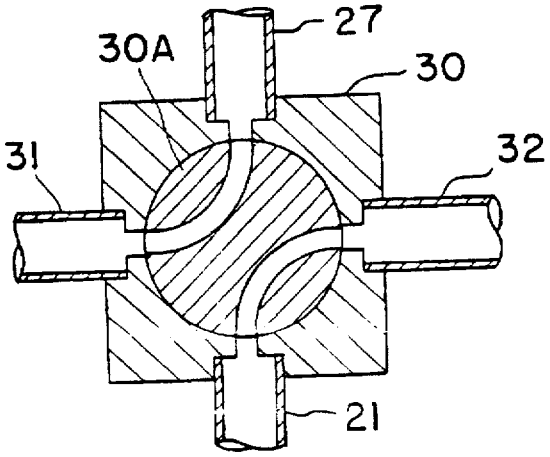
FIG. 7 is a cross sectional view of the four way valve of the same example as FIG. 3 but in a second position.

The four way valve 30 is positioned at a first position where the dispensing head connecting portion 21 is connected to the ascending tube 31 and the dispenser connecting portion 27 is connected to the horizontal tube 32 as shown in FIG. 6, and at a second position where the dispensing head connecting portion 21 is connected to the horizontal tube 32 and the dispenser connecting portion 27 is connected to the ascending tube 31 as shown in FIG. 7.

When the four way valve 30 is positioned at the first position, the beverage introduced from the dispensing head connecting portion 21 is supplied to the dispenser via the ascending tube 31, the upper body 24, the descending tube 25, the valve seat body 26, the horizontal tube 32, the four way valve 30 and the dispenser connecting portion 27. At that time, the floating ball (not shown) floats in the beverage due to its buoyancy so as not to close the flowing path. When beverage in the keg is used up to introduce carbonic acid gas into the descending tube 25 to thereby mix carbonic acid gas with beverage therein, the floating ball is pushed to a valve seat of the descending tube 25 to close the flowing path.

When the flowing path is closed as stated above, after the keg is exchanged for a new one, the four way valve 30 is positioned at the second position so that beverage introduced from the dispensing head connecting portion 21 flows to the valve seat body 26 via the horizontal tube 32 to lift the floating ball to thereby separate it from the valve seat of the descending tube 25.

The beverage is introduced into the descending tube 25 by separating the floating ball from the valve seat to float the floating ball in the beverage. Carbonic acid gas in the descending tube 25 is released via the upper body 24, the ascending tube 31, the four way valve 30 and the dispenser connecting portion 27. Thereafter, the four way valve 30 is positioned at the first position to supply the beverage to the dispenser.

A cylindrical cock can be used for a valve body of a four way valve instead of the ball valve body 30A of the four way valve 30.

Figure 8:
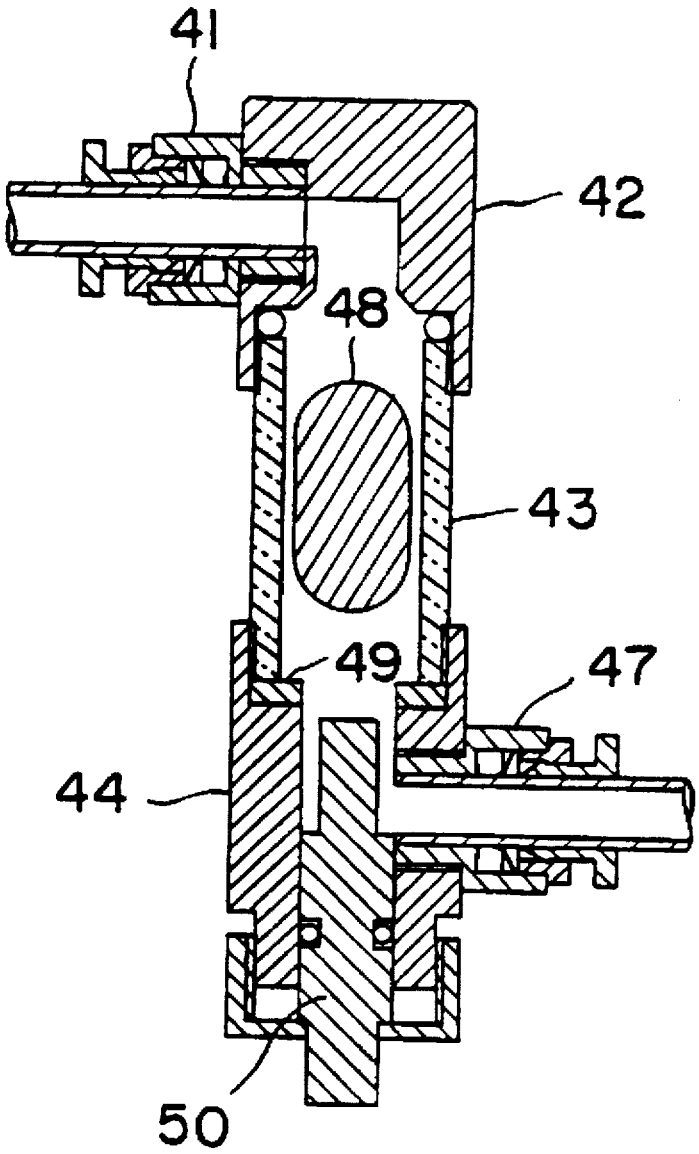
FIG. 8 is a cross sectional view of another example of this invention.
Figure 9:
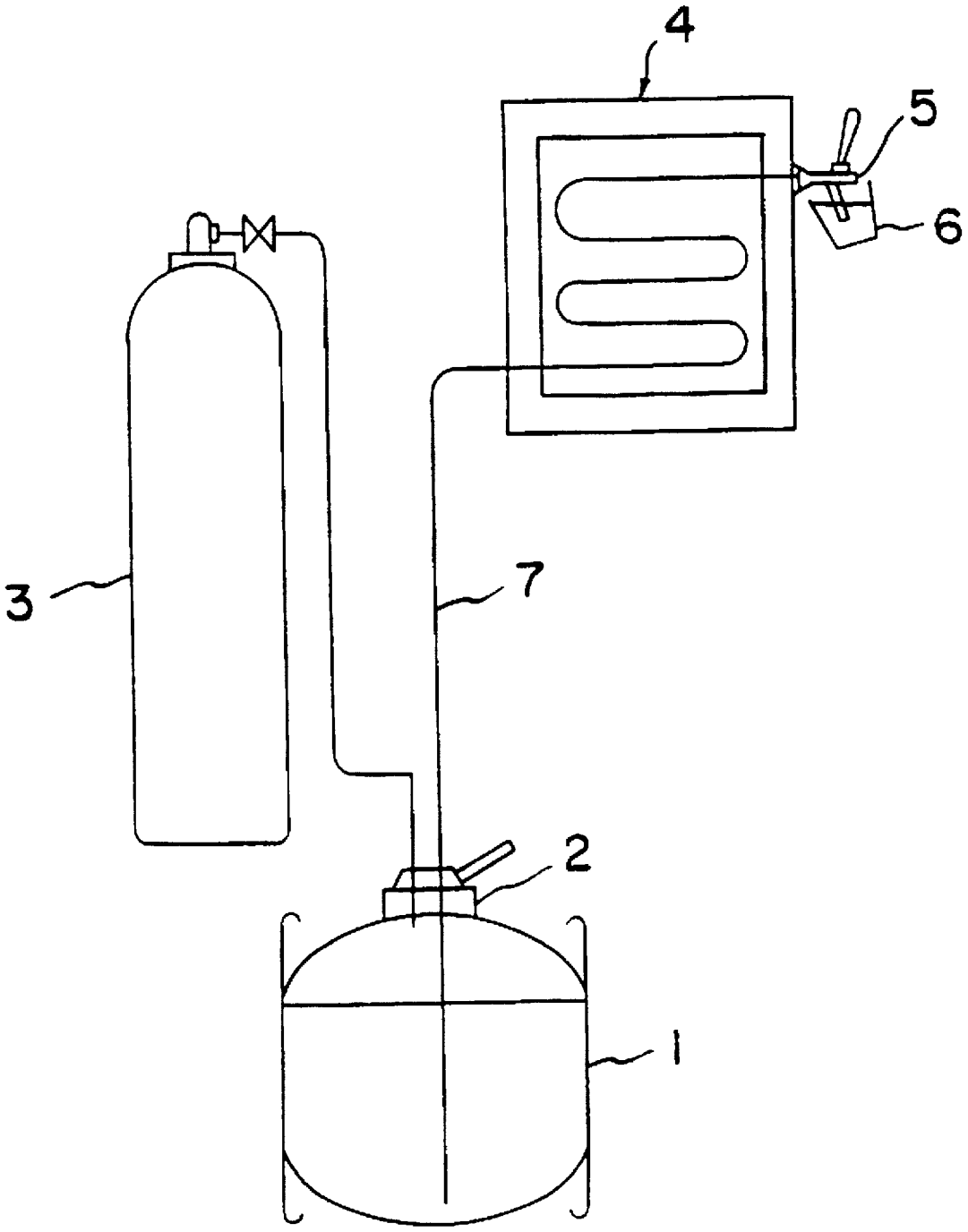
FIG. 9 PRIOR ART
FIG. 9 is an explanatory view for explaining construction of a conventional beverage pouring apparatus; and, FIG. 10 is an explanatory view for explaining construction of a conventional flowing path closing mechanism.
Figure 10:
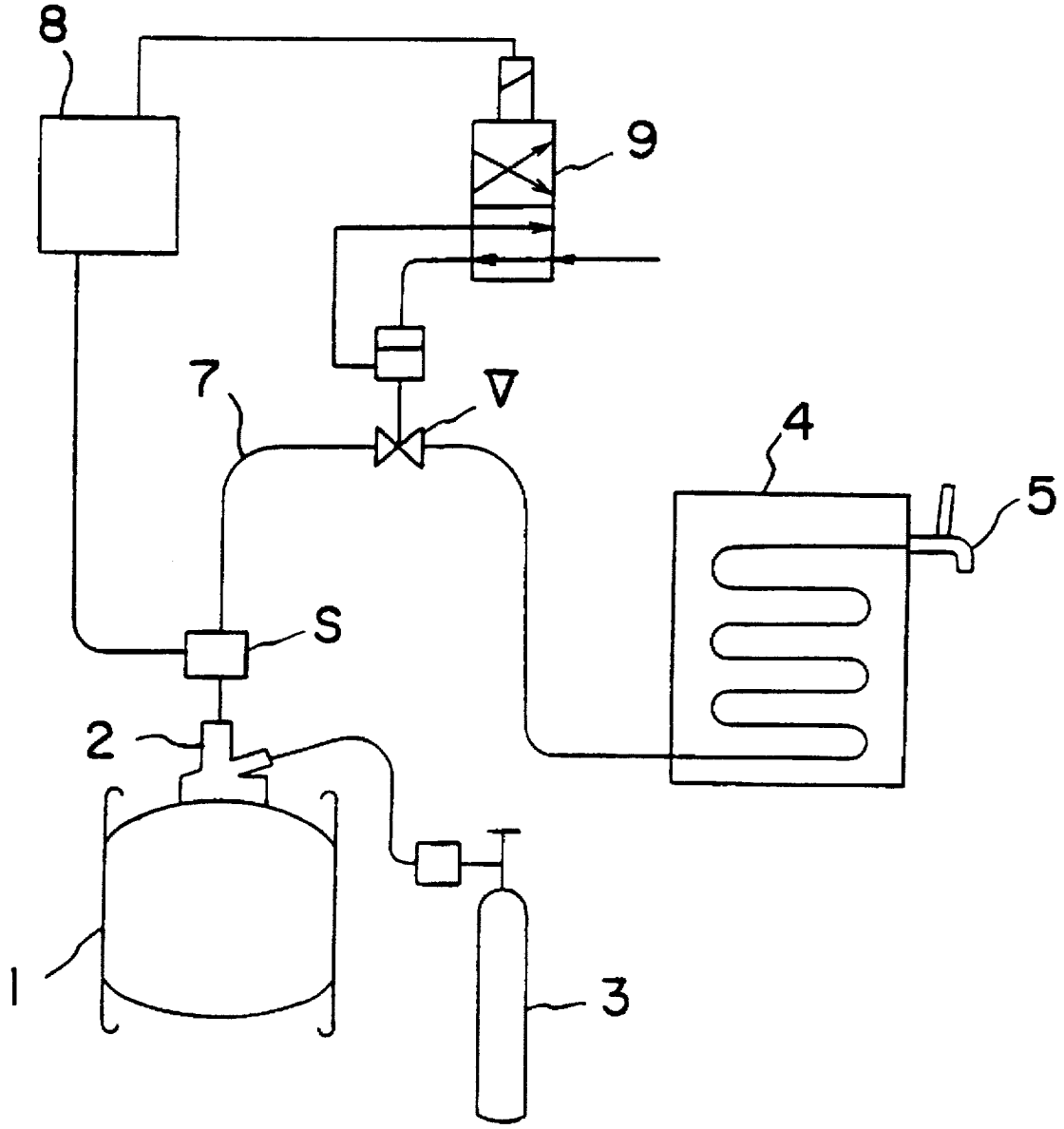
FIG. 10 PRIOR ART

Another embodiment of the flowing path closing mechanism of this invention is shown in FIG. 8.

In this embodiment, an ascending tube is not used. Namely, a dispensing head connecting portion 41 is directly connected to an upper end portion of a descending tube 45 to introduce beverage therein to thereby permit the beverage to flow in a downward direction.

The construction of a floating ball 48, a valve seat 49, a pushing bar 50 and a dispenser connecting portion 47 is the same as those in the embodiment in FIGS. 1 and 2.

Obviously, numerous modifications and variations of the present invention are possible in light of the above teachings. It is therefore to be understood that within the scope of the appended claims, the invention may be practiced otherwise than as specifically described herein.

What is claimed is:

1. A flow passage closing mechanism of a beverage pouring apparatus supplying a beverage in a keg to a dispenser under pressure of gas introduced into the keg, the mechanism comprising:

a first connecting portion connecting to the keg to the mechanism and introducing the beverage into the mechanism;

a descending tube having upper and lower ends which are connected to the first connecting portion and permitting the beverage to flow in a downward and upward direction;

a floating ball movably positioned in the descending tube to float in the beverage flowing in the descending tube due to buoyancy of the floating ball;

a valve seat formed at the lower end of the descending tube, said valve seat closing a flow passage in the descending tube by engagement of the floating ball with the valve seat;

a separating means for lifting the floating ball engaged with the valve seat and separating the floating ball therefrom; and a second connecting portion connecting the mechanism to the dispenser, said dispenser dispensing the beverage passed through the descending tube to the dispenser, wherein the separating means comprises a four-way valve which is positionable at a first position for passing the beverage in the downward direction through the descending tube and at a second position for passing the beverage in the upward direction through the descending tube.

2. The flow passage closing mechanism of the beverage pouring apparatus according to claim 1, wherein the four way valve has a first mouth connected to the first connecting portion, a second mouth connected to the upper end of the descending tube, a third mouth connected to the lower end of the descending tube and a fourth mouth connected to the second connecting portion, wherein the four way valve connects the first mouth to the second mouth and the third mouth to the fourth mouth at the first position permitting the beverage to flow in the downward direction, and connects the first mouth to the third mouth and the second mouth to the fourth mouth at the second position permitting the beverage to flow in the upward direction.

3. A flowing passage closing mechanism of a beverage pouring apparatus supplying a beverage in a keg to a dispenser under pressure of gas introduced into the keg, the mechanism comprising:

a first connecting portion connecting the keg to the mechanism and introducing the beverage into the mechanism;

a descending tube having upper and lower ends which are connected to the first connecting portion and permitting the beverage to flow in a downward and upward direction;

a floating ball movably positioned in the descending tube to float in the beverage flowing in the descending tube due to buoyancy of the floating ball;

a valve seat formed at the lower end of the descending tube, said valve seat closing a flow passage in the descending tube by engagement of the floating ball with the valve seat;

a separating mechanism lifting the floating ball engaged with the valve seat and separating the floating ball therefrom; and a second connecting portion connecting the mechanism the dispenser, said dispenser dispensing the beverage passed through the descending tube to the dispenser, wherein the separating mechanism comprises a four-way valve which is positionable at a first position for passing the beverage in the downward direction through the descending tube and at a second position for passing the beverage in the upward direction through the descending tube.

4. The flowing passage closing mechanism of the beverage pouring apparatus according to claim 3, wherein the four-way valve has a first mouth connected to the first connecting portion, a second mouth connected to the upper end of the descending tube, a third mouth connected to the lower end of the descending tube and a fourth mouth connected to the second connecting portion, wherein the four-way valve connects the first mouth to the second mouth and the third mouth to the fourth mouth at the first position permitting the beverage to flow in the downward direction, and connects the first mouth to the third mouth and the second mouth to the fourth mouth at the second position permitting the beverage to flow in the upward direction.

* * * * *